US007075020B2

(12) United States Patent
Asada

(10) Patent No.: US 7,075,020 B2
(45) Date of Patent: Jul. 11, 2006

(54) PUSH-ON SWITCH

(75) Inventor: Makoto Asada, Nara (JP)

(73) Assignee: Hosiden Corporation, Yao (JP)

( * ) Notice: Subject to any disclaimer, the term of this patent is extended or adjusted under 35 U.S.C. 154(b) by 0 days.

(21) Appl. No.: 11/086,415

(22) Filed: Mar. 23, 2005

(65) Prior Publication Data

US 2005/0211536 A1 Sep. 29, 2005

(30) Foreign Application Priority Data

Mar. 23, 2004 (JP) ..... 2004-084961

(51) Int. Cl.
*H01H 5/18* (2006.01)

(52) U.S. Cl. ..... 200/1 B; 200/406; 200/516; 200/515

(58) Field of Classification Search .... 200/16 A–16 D, 200/406, 512–517, 405, 341, 345, 1 B
See application file for complete search history.

(56) References Cited

U.S. PATENT DOCUMENTS

| | | | | |
|---|---|---|---|---|
| 3,967,084 A | | 6/1976 | Pounds | |
| 3,996,427 A | * | 12/1976 | Kaminski | 200/5 A |
| 4,254,309 A | * | 3/1981 | Johnson | 200/5 A |
| 4,385,218 A | | 5/1983 | Nishida | |
| 5,924,555 A | * | 7/1999 | Sadamori et al. | 200/512 |
| 6,417,467 B1 | * | 7/2002 | Yamagata | 200/5 A |
| 6,548,779 B1 | * | 4/2003 | Takahashi et al. | 200/516 |
| 6,593,537 B1 | * | 7/2003 | Teruyama et al. | 200/515 |
| 6,768,074 B1 | * | 7/2004 | Iwama | 200/515 |
| 6,951,991 B1 | * | 10/2005 | Asada et al. | 200/406 |
| 6,982,394 B1 | * | 1/2006 | Ide et al. | 200/516 |
| 2003/0209418 A1 | | 11/2003 | Yanai et al. | |

FOREIGN PATENT DOCUMENTS

| | | |
|---|---|---|
| JP | 7-53234 | 12/1995 |
| JP | 2003-77368 | 3/2003 |

* cited by examiner

*Primary Examiner*—Michael A. Friedhofer
(74) *Attorney, Agent, or Firm*—Bacon & Thomas

(57) ABSTRACT

A two-step push-on switch sequentially operates first and second switches via a movable contact plate configured by a metal plate spring and fixed by an adhesive tape onto a circuit board. A spacer is placed around the movable contact plate. A continuous or discontinuous tape-sticking face is lower than the top of a center plate portion and higher than a peripheral plate portion due to the spacer around the movable contact plate, thereby preventing the tape from sticking to the peripheral plate portion. In the tape, non-adhesive portions are formed in places opposing to parts of the peripheral plate portion of the movable contact plate excluding at least the connecting portions with the connecting plate portions respectively. When the adhesive tap makes contact with the peripheral plate portion during operation of the first switch, the adhesive tape is prevented from sticking to the peripheral plate portion.

7 Claims, 7 Drawing Sheets

PUSH-ON SWITCH

BACKGROUND OF THE INVENTION

1. Field of the Invention

The present invention relates to a two-step push-on switch in which first and second switches are sequentially turned ON as a result of a depressing operation.

2. Description of the Prior Art

Conventionally, a two-step push-on switch is known in which a movable contact plate that is formed by a metal plate spring, and that has: an annular peripheral plate portion; a center plate portion upward inflatingly curved; and a connecting plate portion connecting these plate portions together is placed in a switch case incorporating first and second stationary contacts, and, as a result of an operation of depressing the center plate portion, the connecting plate portion is downward inclinedly inverted to make contact with the first stationary contact (a first switch is turned ON), and subsequently the center plate portion is inverted to a downward inflated state to make contact with the second stationary contact (a second switch is turned ON) (for example, see Japanese Utility Model Publication No. 7-53234).

A technique for thinning a push-on switch has been proposed in which an adhesive tape is applied directly to the upper face of a movable contact plate configured by a spherical click spring, to fix the plate onto a circuit board such as a printed circuit board (PCB) or a flexible printed circuit board (FPC) where a stationary contact that is to make contact with the movable contact plate is disposed (for example, see Japanese Patent Application Laying-Open No. 2003-77368).

The technical concept disclosed in Japanese Patent Application Laying-Open No. 2003-77368 or the like may be applied to the two-step push-on switch disclosed in Japanese Utility Model Publication No. 7-53234 or the like, to configure a very thin two-step push-on switch. In this case, the adhesive tape sticking to the peripheral plate portion of the movable contact plate deteriorates the operation characteristics (elasticity) of the peripheral plate portion such as expansion and contraction, whereby the first-step pressing load for turning ON the first switch is increased, and the first-step sense produced when the first switch is turned ON is blunted (deteriorated). Therefore, a problem which is to be solved by the invention is that a movable contact plate configured by a metal plate spring cannot be fixed by an adhesive tape onto a circuit board without deteriorating the operation characteristics of the movable contact plate.

SUMMARY OF THE INVENTION

The invention set forth in claim 1 configures a very thin two-step push-on switch which comprises a movable contact plate formed by a metal plate spring, and in which the movable contact plate is fixed onto a circuit board by an adhesive tape that is bonded from a side of an upper face of movable contact plate, the movable contact plate having: an annular peripheral plate portion; a center plate portion which is upward inflatingly curved; and connecting plate portions which connect the peripheral plate portion and the center plate portion together, the connecting plate portions being inverted by an operation of depressing the center plate portion to a downward inclined state to make contact with first stationary contacts on the circuit board, the center plate portion being then inverted to a downward inflated state to make contact with a second stationary contact on the circuit board. In order to enable the movable contact plate configured by a metal plate spring to be fixed onto the circuit board without deteriorating the operation characteristics of the movable contact plate, the push-on switch further comprises a spacer which is placed around the movable contact plate on the circuit board, and a continuous or discontinuous tape-sticking face is formed by the spacer around the movable contact plate, the tape-sticking face being lower in level than a top of the center plate portion and higher than the peripheral plate portion.

In the invention set forth in claim 1, in the case where a continuous tape-sticking face is to be formed around the movable contact plate, a single annular spacer is used, and, in the case where a discontinuous tape-sticking face is to be formed, a plurality of spacers are used.

In the former case, preferably, an air passage through which a covered space inside the annular spacer covered by the adhesive tape is communicatingly connected to a covered space outside the spacer is formed in the spacer, and the push-on switch further comprises air escape means through which the covered space outside the spacer communicates with a space outside the adhesive tape. Preferably, the air escape means is formed in the vicinity of an opening of the air passage on a side of the covered space outside the spacer. The air passage in the annular spacer may be formed in either of the following manners. A groove of a predetermined depth is disposed in the tape-sticking face of the upper face of the spacer to elongate from an inner peripheral edge of the tape-sticking face to an outer peripheral edge, so that the air passage can be formed between the tape-sticking face of the upper face of the spacer and the adhesive tape sticking to the tape-sticking face. A groove of a predetermined depth is disposed in a lower face of the spacer to elongate from an inner peripheral edge of the lower face to an outer peripheral edge, so that the air passage can be formed between the lower face of the spacer and the circuit board joined to the lower face. The annular spacer is interrupted in one place (this is equivalent to a case where the above-mentioned groove in the upper or lower face of the spacer is formed so as to reach the opposite face or the lower or upper face), so that the air passage can be formed between the adhesive tape sticking to the tape-sticking face of the upper face of the spacer and the circuit board joined to the lower face of the spacer, or can be formed along the whole thickness of the spacer. A through hole which passes through the spacer from an inner peripheral wall to an outer peripheral wall is disposed in the spacer, so that the air passage can be formed inside the spacer. The air escape means may be formed by opening a hole in the adhesive tape, or forming a slit in the adhesive tape, or by forming a nonadhesive portion in a part of the adhesive tape to form a passage between the tape and the circuit board. Each of the hole, the slit, and the passage can serve as an air escape through which the covered space outside the spacer communicates with the space outside the adhesive tape.

In the latter case, preferably, the push-on switch further comprises air escape means through which a covered space outside the spacers and covered by the adhesive tape communicates outside the spacers with a space outside the adhesive tape. Preferably, the air escape means is formed in a position corresponding to a communicating portion between the spacers. The air escape means may be formed by opening a hole in the adhesive tape, or forming a slit in the adhesive tape, or by forming a nonadhesive portion in a part of the adhesive tape to form a passage between the tape and the circuit board. Each of the hole, the slit, and the passage can serve as an air escape through which the covered spaces outside the spacer communicate with the space outside the adhesive tape.

The invention set forth in claim 6 configures a very thin two-step push-on switch which comprises a movable contact plate formed by a metal plate spring, and in which the movable contact plate is fixed onto a circuit board by an adhesive tape that is bonded from a side of an upper face of movable contact plate, the movable contact plate having: an annular peripheral plate portion; a center plate portion which is upward inflatingly curved; and connecting plate portions which connect the peripheral plate portion and the center plate portion together, the connecting plate portions being inverted by an operation of depressing the center plate portion to a downward inclined state to make contact with first stationary contacts on the circuit board, and the center plate portion being then inverted to a downward inflated state to make contact with a second stationary contact on the circuit board. In the adhesive tape which fixes the movable contact plate onto the circuit board, nonadhesive portions are formed in places opposing to parts of the peripheral plate portion of the movable contact plate excluding at least connecting portions with the connecting plate portions, respectively.

The adhesive tape having the nonadhesive portions can be obtained by, when an adhesive layer is to be printed onto one surface of a tape base member, applying a masking process to positions where the nonadhesive portions are to be formed. Alternatively, the adhesive tape can be obtained by, to an adhesive tape in which an adhesive layer is formed over an entire surface of a tape base member, bonding a tape base member in which an adhesive layer is not formed or another adhesive tape in which an adhesive layer is formed over one whole surface of a tape base member, in positions where the nonadhesive portions are to be formed. Alternatively, the adhesive tape can be obtained by, to a tape base member, bonding a double-sided adhesive tape (an adhesive tape in which an adhesive layer is formed on both the surfaces of a tape base member) which is cut away only in positions where the nonadhesive portions are to be formed.

The invention set forth in claim 7 configures a very thin two-step push-on switch which comprises a movable contact plate formed by a metal plate spring, and in which the movable contact plate is fixed onto a circuit board by an adhesive tape that is bonded from a side of an upper face of movable contact plate, the movable contact plate having: an annular peripheral plate portion; a center plate portion which is upward inflatingly curved; and connecting plate portions which connect the peripheral plate portion and the center plate portion together, the connecting plate portions being inverted by an operation of depressing the center plate portion to a downward inclined state to make contact with first stationary contacts on the circuit board, and the center plate portion being then inverted to a downward inflated state to make contact with a second stationary contact on the circuit board. In order to enable the movable contact plate configured by a metal plate spring to be fixed onto the circuit board without deteriorating the operation characteristics of the movable contact plate, the push-on switch further comprises a spacer which is placed around the movable contact plate on the circuit board, a continuous or discontinuous tape-sticking face is formed by the spacer around the movable contact plate, the tape-sticking face being lower in level than a top of the center plate portion and higher than the peripheral plate portion, and, in the adhesive tape which fixes the movable contact plate onto the circuit board, nonadhesive portions are formed in places opposing to parts of the peripheral plate portion of the movable contact plate excluding at least connecting portions with the connecting plate portions, respectively.

According to the invention set forth in claim 1, the push-on switch comprises the spacer placed around the movable contact plate on the circuit board, and the continuous or discontinuous tape-sticking face which is lower in level than the top of the center plate portion and higher than the peripheral plate portion is formed by the spacer around the movable contact plate, whereby the tape-sticking face which is higher than the movable contact plate is formed inside and outside the movable contact plate to prevent the adhesive tape from sticking to the peripheral plate portion. According to the configuration, it is possible to prevent the operation characteristics (elasticity) of the peripheral plate portion such as expansion and contraction from being deteriorated. Therefore, the first-step pressing load for turning ON the first switch can be prevented from being increased, and the first-step sense produced when the first switch is turned ON can be prevented from being blunted (deteriorated). As a result, the invention attains a beneficial advantage that it is possible to obtain a very thin two-step push-on switch in which a movable contact plate configured by a metal plate spring can be fixed by an adhesive tape onto a circuit board without deteriorating the operation characteristics of the movable contact plate, and which has excellent operation characteristics.

The continuous tape-sticking face is formed around the movable contact plate with using the annular spacer. In comparison to a configuration in which a discontinuous tape-sticking face is formed around the movable contact plate with using plural spacers, therefore, the production is more advantageous because the number of parts is small and the positioning of the spacer with respect to the movable contact plate can be easily conducted. Moreover, the configuration is advantageous to prevention of the adhesive tape from sticking to the peripheral plate portion.

Furthermore, the air passage through which the covered space inside the annular spacer covered by the adhesive tape communicates with the covered space outside the spacer is formed in the spacer, and the push-on switch further comprises the air escape means through which the covered space outside the annular spacer communicates with the space outside the adhesive tape. Unlike a configuration where the air is caused to directly escape by opening a hole or a slit in an adhesive tape in the position of a movable contact plate, therefore, the air is caused to indirectly escape, and hence it is possible to prevent a contact failure due to penetration of dust into the portion of the movable contact plate from occurring. Therefore, the invention attains a beneficial advantage that it is possible to obtain a very thin two-step push-on switch which has excellent operation characteristics while enhancing the dustproofness. From the viewpoint of the dustproofness also, the formation of the continuous tape-sticking face around the movable contact plate with using the annular spacer is more advantageous than that of a discontinuous tape-sticking face around the movable contact plate with using plural spacers.

In the configuration where the discontinuous tape-sticking face is formed around the movable contact plate with using the plural spacers, it is not required to form the spacers so as to coincide with the shape of the movable contact plate, and hence such spacers can be used in various switches. From this point of view, therefore, the configuration is advantageous to that in which a continuous tape-sticking face is formed around the movable contact plate with using an annular spacer.

Moreover, when the switch comprises air escape means through which a covered space covered by the adhesive tape and communicating with the spacers communicates outside the spacers with an exterior of the adhesive tape, it is possible to attain the same effect as the above-described air escape means.

According to the invention set forth in claim 6, in the adhesive tape which fixes the movable contact plate onto the circuit board, the nonadhesive portions are formed in places opposing to parts of the peripheral plate portion of the movable contact plate excluding at least connecting portions with the connecting plate portions, respectively. Therefore, the adhesive tape can be prevented from sticking to the peripheral plate portion, and, even when the adhesive tape makes contact with the peripheral plate portion during turning-ON of the first switch, the adhesive tape can be prevented from sticking to the peripheral plate portion. According to the configuration, the operation characteristics (elasticity) of the peripheral plate portion such as expansion and contraction can be prevented from being deteriorated, and increasing of the first-step pressing load for turning ON the first switch, and blunting (deterioration) of the first-step sense produced when the first switch is turned ON can be prevented from occurring. As a result, the invention attains a beneficial advantage that it is possible to obtain a very thin two-step push-on switch in which a movable contact plate configured by a metal plate spring can be fixed by an adhesive tape to a circuit board without deteriorating the operation characteristics of the movable contact plate, and which has excellent operation characteristics.

According to the invention set forth in claim 7, the push-on switch comprises the spacer which is placed around the movable contact plate on the circuit board, the continuous or discontinuous tape-sticking face is formed by the spacer around the movable contact plate, the tape-sticking face being lower in level than the top of the center plate portion and higher than the peripheral plate portion, and, in the adhesive tape which fixes the movable contact plate onto the circuit board, nonadhesive portions are formed in places opposing to parts of the peripheral plate portion of the movable contact plate excluding at least connecting portions with the connecting plate portions, respectively. Therefore, the adhesive tape can be prevented from sticking to the peripheral plate portion, and, even when the adhesive tape makes contact with the peripheral plate portion during turning-ON of the first switch, the adhesive tape can be prevented from sticking to the peripheral plate portion. According to the configuration, the operation characteristics (elasticity) of the peripheral plate portion such as expansion and contraction can be prevented from being deteriorated, and also from being deteriorated by tape tension due to close contact of the adhesive tape with the peripheral plate portion, and increasing of the first-step pressing load for turning ON the first switch, and blunting (deterioration) of the first-step sense produced when the first switch is turned ON can be prevented from occurring. As a result, the invention attains a beneficial advantage that it is possible to obtain a very thin two-step push-on switch in which a movable contact plate configured by a metal plate spring can be fixed by an adhesive tape to a circuit board without deteriorating the operation characteristics of the movable contact plate, and which has excellent operation characteristics.

BRIEF DESCRIPTION OF THE DRAWINGS

FIG. 9 is a central longitudinal sectional view of the push-on switch of the second embodiment showing a state where a first switch is turned ON.

DETAILED DESCRIPTION OF THE PREFERRED EMBODIMENTS

Figure 1:
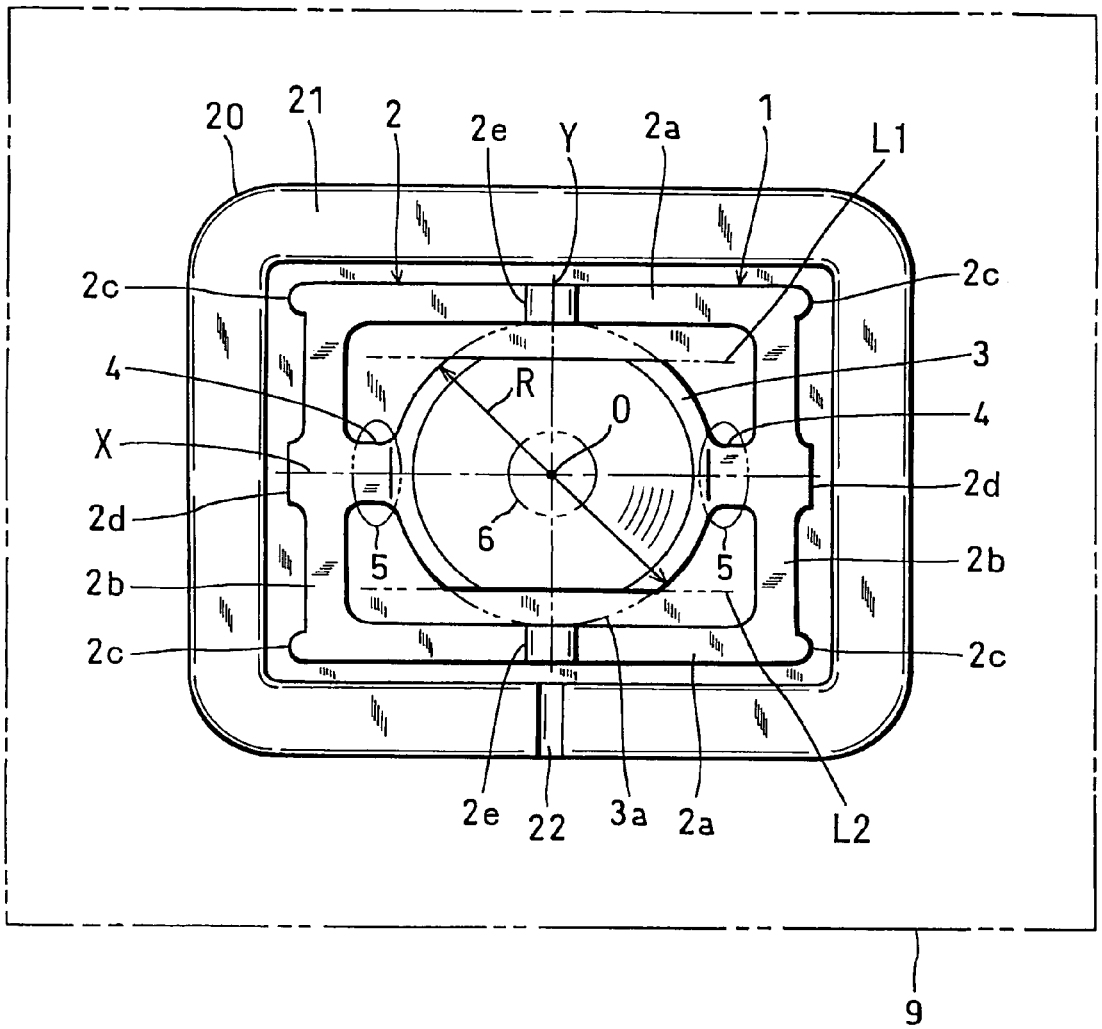
FIG. 1 is a plan view of a push-on switch showing a first embodiment of the invention.
Figure 2:
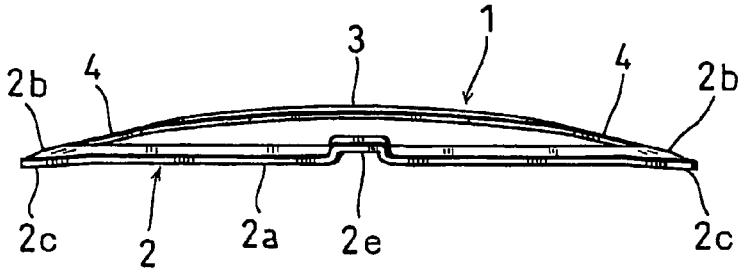
FIG. 2 is a side view of a movable contact plate of the push-on switch of the first embodiment.
Figure 3:
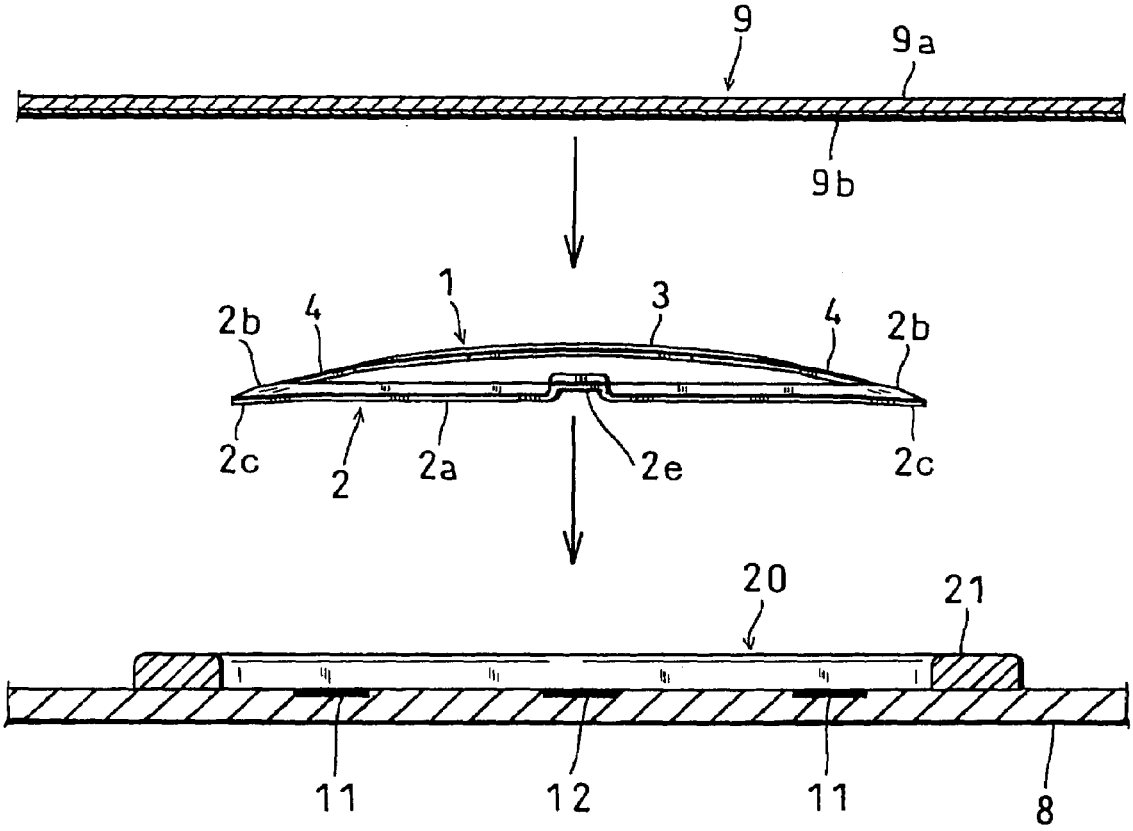
FIG. 3 is a side view showing a disassembled state which is attained before the push-on switch of the first embodiment is assembled.
Figure 4:
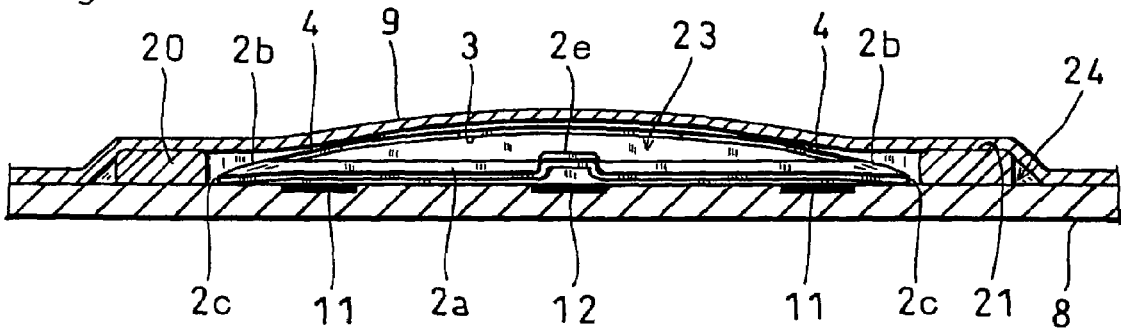
FIG. 4 is a central transverse sectional view showing an assembled state of the push-on switch of the first embodiment.
Figure 5:
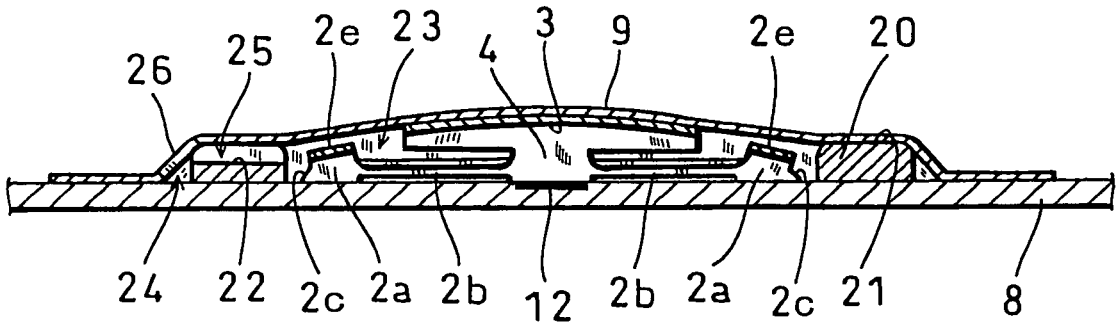
FIG. 5 is a central longitudinal sectional view showing an assembled state of the push-on switch of the first embodiment.
Figure 6A:
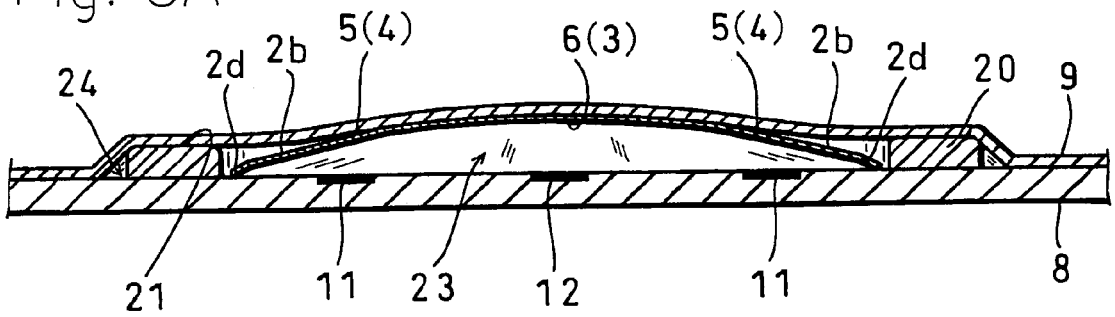
FIG. 6 is a central transverse sectional view showing the operation of the push-on switch of the first embodiment.
Figure 6B:
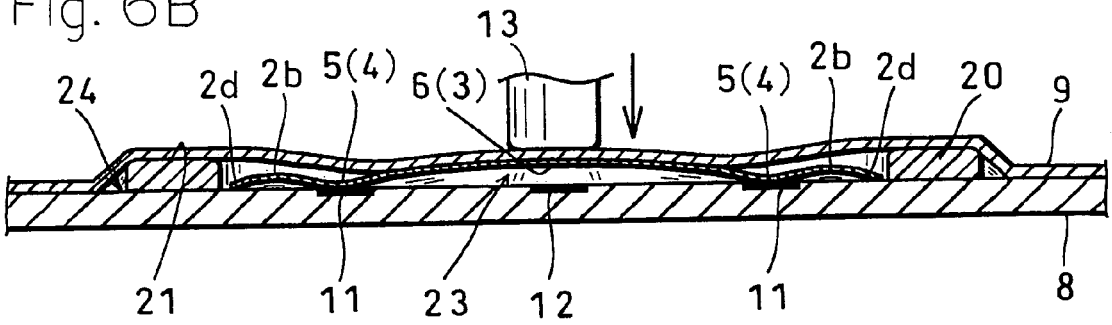
Figure 6C:
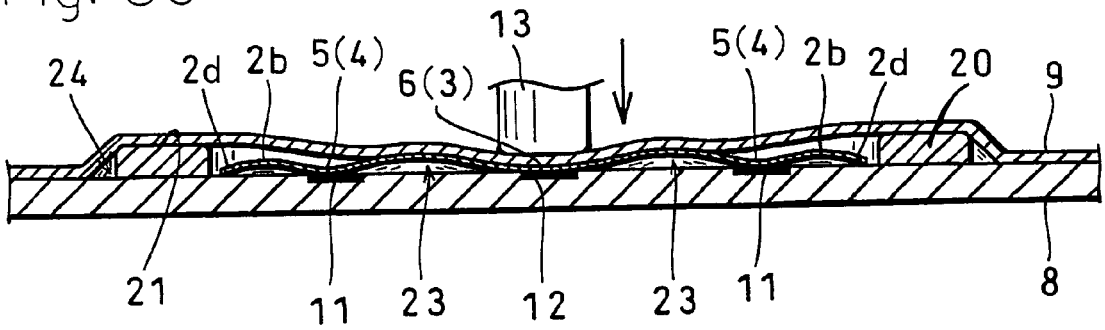

Hereinafter, embodiments of the invention will be described with reference to the accompanying drawings. FIG. 1 is a plan view of a push-on switch showing a first embodiment of the invention, FIG. 2 is a side view of a movable contact plate of the push-on switch of the first embodiment, FIG. 3 is a side view showing a disassembled state which is attained before the push-on switch of the first embodiment is assembled, FIG. 4 is a central transverse sectional view showing an assembled state of the push-on switch of the first embodiment, FIG. 5 is a central longitudinal sectional view showing an assembled state of the push-on switch of the first embodiment, and FIG. 6 is a central transverse sectional view showing the operation of the push-on switch of the first embodiment.

The push-on switch of the first embodiment will be schematically described. The push-on switch is configured in the following manner. First stationary contacts 11, 11 and a second stationary contact 12 are disposed on a circuit board 8 such as a printed circuit board (PCB) or a flexible printed circuit board (FPC). A two-step movable contact plate 1 formed by a metal plate spring is placed on the circuit board 8. The movable contact plate 1 has: first movable contacts 5, 5 which are to make contact with the first stationary contacts 11, 11, respectively; and a second movable contact 6 which is to make contact with the second stationary contact 12. A spacer 20 is placed around the movable contact plate 1. The movable contact plate 1 and the spacer 20 are fixed integrally onto the circuit board 8 by a single insulating adhesive tape 9 which sticks to the upper faces of the plate and spacer. Namely, the first embodiment is configured as a very thin two-step push-on switch in which first and second switches are sequentially turned ON as a result of a depressing operation.

Then, the configurations of the components of the push-on switch of the first embodiment will be described in detail. The movable contact plate 1 is formed by conducting a pressing process on one thin plate spring member made of a metal, and has: an annular peripheral plate portion 2; a center plate portion 3 which is upward inflatingly curved;

and a pair of narrow-width connecting plate portions 4, 4 which connect these plate portions together. The peripheral plate portion 2 is formed into a rectangular annular frame-like shape. In the peripheral plate portion 2, a pair of long side portions 2*a*, 2*a* and a pair of short side portions 2*b*, 2*b*, i.e., the whole periphery of the peripheral plate portion 2 is upward inclined as advancing from the outer side edge toward the inner side edge. Outer side edges of the end portions and middle portions of the short side portions 2*b*, 2*b* are partially protruded in an obliquely downward direction along the inclination of the short side portions 2*b*, 2*b*, thereby forming grounding parts 2*c*, 2*c*, 2*c*, 2*c*, 2*d*, 2*d* of the movable contact plate 1. The peripheral plate portion 2 (the movable contact plate 1) is supported in a state where it is raised from the circuit board 8 or a flat mounting surface by a predetermined height, at a total of six grounding parts, i.e., the four-corner grounding parts 2*c*, 2*c*, 2*c*, 2*c* of the peripheral plate portion 2 which are the four corners of the movable contact plate 1, and the pair of grounding parts 2*d*, 2*d* on a long direction-center line X of the peripheral plate portion 2 (the movable contact plate 1) which is parallel to the long side portions 2*a*, 2*a*. In middle portions of the long side portions 2*a*, 2*a*, portions through which a short direction-center line Y of the peripheral plate portion 2 (the movable contact plate 1) that is parallel to the short side portions 2*b*, 2*b* passes are partially upward protruded to form trapezoidal bent portions 2*e*, 2*e*. The bent portions 2*e*, 2*e* enable the peripheral plate portion 2 to expand and contract in the longitudinal direction, and the upper faces of the bent portions are formed so as to be substantially flush with a curved surface (spherical surface) of the upper face of the center plate portion 3 which will be described later.

The pair of connecting plate portions 4, 4 connect the inner side edge of the peripheral plate portion 2 to the outer peripheral edge of the center plate portion 3 on the long direction-center line X. One end of each of the connecting plate portions is connected to the inner side edge of a middle portion of the corresponding one of the short side portions 2*b*, 2*b* of the peripheral plate portion. The connecting plate portions extend toward the center O (an intersection of the long direction-center line X and the short direction-center line Y) of the peripheral plate portion 2 (the movable contact plate 1), so that the other ends are connected to the outer peripheral edge of the center plate portion 3. The connecting plate portions 4, 4 are upward inclined as advancing from the peripheral plate portion 2 toward the center plate portion 3 along the inclination of the short side portions 2*b*, 2*b* to which the ends of the connecting plate portions are connected, thereby supporting the center plate portion 3 in a state where it is raised from the peripheral plate portion 2 by a predetermined height. The inclination of the connecting plate portions 4, 4 is set to an angle by which the upward-inclined short side portions 2*b*, 2*b* of the peripheral plate portion 2 are connected to the upward-inclined center plate portion 3 that is upward inflatingly curved, without forming a step or in a substantially flush state.

The center plate portion 3 is formed into an oval shape which is obtained by cutting away peripheral portions of a circular plate 3*a* with two straight lines (parallel lines) L1, L2 which are parallel to the long side portions 2*a*, 2*a* of the peripheral plate portion 2, and the distance between which is shorter than the relative distance between the inner side edges of the long side portions 2*a*, 2*a*. The circular plate 3*a* is upward inflatingly curved, and has a diameter R which is substantially equal to or shorter than the relative distance between the inner side edges of the short side portions 2*b*, 2*b* of the peripheral plate portion 2, and which is longer than the relative distance between the inner side edges of the long side portions 2*a*, 2*a*. In a plan view, the center plate portion 3 is concentrically disposed inside the peripheral plate portion 2, in a direction (posture) in which the linear cut edges of the center plate portion 3 elongate along the long side portions 2*a*, 2*a* of the peripheral plate portion 2, and the arcuate uncut edges are opposed to the short side portions 2*b*, 2*b* of the peripheral plate portion 2, respectively. Middle portions of the arcuate uncut edges of the center plate portion 3 are connected via the pair of connecting plate portions 4, 4 to the inner side edges of middle portions of the short side portions 2*b*, 2*b* of the peripheral plate portion 2, whereby the center plate portion 3 is supported at a concentric position inside the peripheral plate portion 2 in a plan view.

In the thus configured movable contact plate 1, the portions of the pair of connecting plate portions 4, 4 which are connected to the center plate portion 3 are formed as the first movable contact portions 5, 5, respectively, and the center part of the center plate portion 3 is formed as the second movable contact portion 6.

The spacer 20 is made of an insulating material, and formed as a whole into a rectangular annular frame-like shape which is slightly larger than the peripheral plate portion 2 of the movable contact plate 1, so as to surround the periphery of the movable contact plate 1. The frame portion is formed so as to have a rectangular section shape. The thickness of the frame portion of the spacer 20 is set so that, when the spacer 20 is placed on the circuit board 8 with joining the lower face thereto, the upper face of the spacer 20 is lower in level than the top (center part) of the center plate portion 3 of the movable contact plate 1 which is placed with joining the six grounding parts 2*c*, 2*c*, 2*c*, 2*c*, 2*d*, 2*d* onto the circuit board 8, and higher than the bent portions 2*e*, 2*e* of the peripheral plate portion 2. In the periphery of the movable contact plate 1, therefore, the upper face of the spacer 20 forms a continuous tape-sticking face 21 which has a predetermined width, and which is lower in level than the top of the center plate portion 3, and higher than the bent portions 2*e*, 2*e* of the peripheral plate portion 2.

In the upper face (the tape-sticking face 21) of a long-direction center portion (on the extension of the short direction-center line Y of the movable contact plate 1) of one of the pair of long side portions of the frame portion of the spacer 20, a thin groove 22 having a predetermined depth is linearly formed to elongate from the inner peripheral edge to the outer peripheral edge, whereby an air passage which will be described later is formed in the spacer 20.

Edges of the inner and outer peripheral sides of the upper face of the spacer 20 are rounded with a predetermined radius to prevent the adhesive tape 9 from being broken by the inner and outer peripheral edges of the upper face of the spacer 20.

In the adhesive tape 9, a layer 9*b* of an adhesive agent is formed over one whole surface of a tape base member 9*a* made of a resin film which has flexible, elastic, and insulative properties. The adhesive tape 9 is formed into a rectangular shape having a size allowing the tape to integrally cover the movable contact plate 1 placed on the circuit board 8 and the spacer 20 placed around the plate, and the outer peripheral edge portion to stick onto the circuit board 8 in the outer circumference of the spacer 20.

Next, the manner of assembling the push-on switch of the first embodiment will be described. The movable contact plate 1 is placed on exposed surfaces of the first stationary contacts 11, 11 and the second stationary contact 12 on the circuit board 8 configured as a printed circuit board (PCB)

or a flexible printed circuit board (FPC) so that the first movable contacts 5, 5 are opposed respectively to the first stationary contacts 11, 11 and the second movable contact 6 is opposed to the second stationary contact 12. The spacer 20 is placed around the movable contact plate 1 on the circuit board 8 so as to surround the movable contact plate 1. Under this condition, the adhesive tape 9 sticks to the upper faces of the movable contact plate 1 and the spacer 20, and the circuit board 8 in a state of tension so as to integrally cover the movable contact plate 1 and the spacer 20 from the upper side, whereby the movable contact plate 1 and the spacer 20 are directly positionally fixed onto the circuit board 8 in an integral manner. Consequently, a very thin two-step push-on switch in which the first and second switches are sequentially turned ON as a result of a depressing operation is assembled.

In the thus assembled push-on switch of the first embodiment, the continuous tape-sticking face 21 which is lower in level than the top of the center plate portion 3, and higher than the bent portions 2*e*, 2*e* of the peripheral plate portion 2 is formed by the upper face of the spacer 20 placed around the movable contact plate 1 on the circuit board 8. Therefore, the movable contact plate 1 and the spacer 20 are positionally fixed onto the circuit board 8 in an integral manner in a state where the adhesive tape 9 sticks in the center portion to the top (the highest tape-sticking face) of the center plate portion 3 and then sticks to the tape-sticking face 21 in the upper face the spacer 20 which is the highest portion next to the top of the center plate portion 3, the outer peripheral edge of the adhesive tape 9 finally sticks onto the circuit board 8 (the tape-sticking face which is lower than the tape-sticking face 21 of the spacer 20, i.e., the lowest tape-sticking face), and the adhesive tape 9 does not stick to the peripheral plate portion 2 which is positioned between the center plate portion 3 and the spacer 20, and which is lower in level than the top of the center plate portion 3 and the tape-sticking face 21 on the upper face of the spacer 20, with forming a gap above the peripheral plate portion.

In the thus assembled push-on switch of the first embodiment, a covered space 23 defined by the inner peripheral wall of the spacer 20, the circuit board 8, and the adhesive tape 9 is formed inside the spacer 20. The movable contact plate 1 is housed in the covered space 23. A covered space 24 defined by the outer peripheral wall of the spacer 20, the circuit board 8, and the adhesive tape 9 which is obliquely stretched between the tape-sticking face 21 of the spacer 20 and the circuit board 8 is formed outside the spacer 20. An air passage 25 through which the covered space 23 inside the spacer 20 is communicatingly connected to the covered space 24 outside the spacer is formed between the tape-sticking face 21 of the upper face of the spacer 20 and the adhesive tape 9 sticking to the face, by the groove 22 formed in the spacer 20.

In the thus assembled push-on switch of the first embodiment, air escape means 26 through which the covered space 24 outside the spacer 20 communicates with the space outside the adhesive tape 9 is formed in the vicinity of an opening of the air passage 25 on the side of the covered space 24 outside the spacer 20, so that the air in the covered space 23 which houses the movable contact plate 1, and which is inside the spacer 20 can escape indirectly from the covered space 24 outside the spacer 20 to the space outside the adhesive tape 9. The air escape means 26 is formed by opening a hole in the adhesive tape 9, or forming a slit in the adhesive tape, or by forming a nonadhesive portion in a part of the adhesive tape to form a passage between the tape and the circuit board. Each of the hole, the slit, and the passage can serve as an air escape through which the covered space outside the spacer communicates with the space outside the adhesive tape. In the embodiment, a slit is shown as an example of the air escape means 26.

Next, the operation of the push-on switch of the first embodiment, i.e., that of the movable contact plate 1 will be described with reference to FIG. 6. In an initial state, as shown in (A) of FIG. 6, the movable contact plate 1 is separated from and opposed to the first stationary contacts 11, 11 and the second stationary contact 12. When, in order to turn ON the first switch of the push-on switch, the center plate portion 3 of the movable contact plate 1 is depressed by a press operating member 13 from the side above the adhesive tape 9, the center plate portion 3 is first depressed while maintaining the upward inflatingly curved state. In accordance with the depressing operation, while the long side portions 2*a*, 2*a* of the peripheral plate portion 2 are downward flexurally deformed, the connecting plate portions 4, 4 which are upward inclined as advancing from the peripheral plate portion 2 toward the center plate portion 3 fall down with being bent in the portions where the connecting plate portions 4, 4 are connected to the center plate portion 3. In the initial stage of the falling operation of the connecting plate portions 4, 4, the short side portions 2*b*, 2*b* of the peripheral plate portion 2 which is formed into a rectangular annular shape are pressed from the inner side toward the outer side, whereby the peripheral plate portion 2 is extended in the longitudinal direction while expandingly deforming the bent portions 2*e*, 2*e* formed in the middle portions of the long side portions 2*a*, 2*a*. After a timing when the connecting plate portions 4, 4 exceed a horizontal posture, then, the connecting plate portions 4, 4 are rapidly inverted (elastically deformed) to a downward inclined posture by the assistance of the elasticity of the peripheral plate portion 2 in which the portion tries to contract by a degree corresponding to the longitudinal elongation. As shown in (B) of FIG. 6, the first movable contact portions 5, 5 in the portions where the connecting plate portions 4, 4 are connected to the center plate portion 3 make contact while producing an excellent sense (click sensation) with the first stationary contacts 11, 11 of the circuit board 8, i.e., the first stationary contacts 11, 11 which are in the same plane as the supporting surface of the peripheral plate portion 2, thereby producing an ON state of the first switch. In the embodiment, the pair of connecting plate portions 4, 4 connect the inner side edge of the peripheral plate portion 2 to the outer peripheral edge of the center plate portion 3 on the long direction-center line X. Therefore, the operation stroke for the first step can be sufficiently ensured, and a more excellent sense is produced in the first step. Although the operation stroke for the first step is sufficiently ensured to produce an excellent sense in the first step, the width is not increased, but decreased. Since the adhesive tape 9 does not stick to the peripheral plate portion 2 as described above, the push-on switch can sufficiently exhibit the original operation characteristics (elasticity) of the peripheral plate portion 2 such as expansion and contraction, and it is possible to obtain an original excellent sense of the first step.

When, in the ON state of the first switch, the center plate portion 3 of the movable contact plate 1 is further depressed by the press operating member 13, the center part of the center plate portion 3 which is supported by the first movable contact portions 5, 5 in the portions where the connecting plate portions 4, 4 are connected to the center plate portion 3 is rapidly inverted to a downward inflated state, and inverted (elastically deformed) to a downward inflated state while producing an excellent sense, at a timing when the center part cannot withstand the depressing force. As shown in (C) of FIG. 6, the second movable contact portion 6 in the center part of the center plate portion 3 makes contact while producing an excellent sense with the second stationary contact 12 of the circuit board 8, i.e., the second stationary contact 12 which is on the same plane as the supporting surface of the peripheral plate portion 2, thereby producing an ON state of a second switch.

When the depressing force applied to the center plate portion 3 of the movable contact plate 1 by the press operating member 13 is then cancelled, the center part of the center plate portion 3 is first caused by the elasticity to be restored to the upward inflated state, whereby the second movable contact portion 6 is separated from the second stationary contact 12, so that the second switch is returned to the state of (B) of FIG. 6 or the OFF state. Subsequently, the connecting plate portions 4, 4 are restored to the upward inclined state, and the peripheral plate portion 2 contracts by a degree corresponding to the longitudinal elongation, whereby the first movable contact portions 5, 5 are separated from the first stationary contacts 11, 11, respectively, so that both the first and second switches shown in (A) of FIG. 6 are returned to the OFF state (initial state).

When the first switch of the push-on switch is turned ON and the second switch is then turned ON, as described above, the area of the covered space 23 inside the spacer 20 is reduced, and the internal pressure of the push-on switch tries to rise. In accordance with the area reduction of the covered space 23 inside the spacer 20, however, the air in the covered space 23 inside the spacer 20 is caused to indirectly escape through the air escape means 26 to the space outside the adhesive tape 9 from the covered space 23 outside the spacer 20 which is communicatingly connected to the covered space 23 inside the spacer 20 via the air passage 25. Therefore, the internal pressure of the push-on switch is not raised, and an excellent sense is produced in both the first and second steps.

Figure 7:
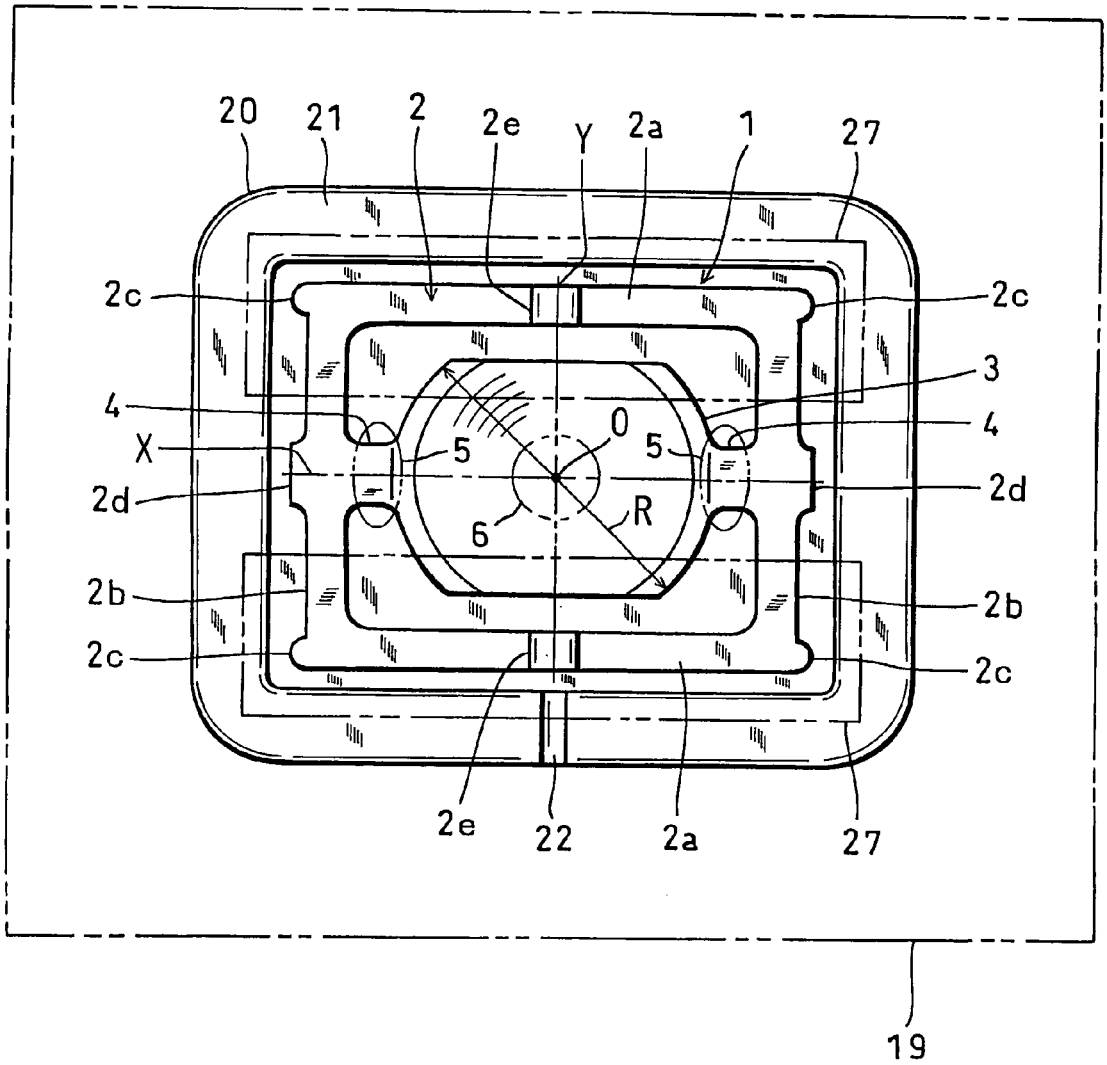
FIG. 7 is a plan view of a push-on switch of a second embodiment of the invention.
Figure 8:
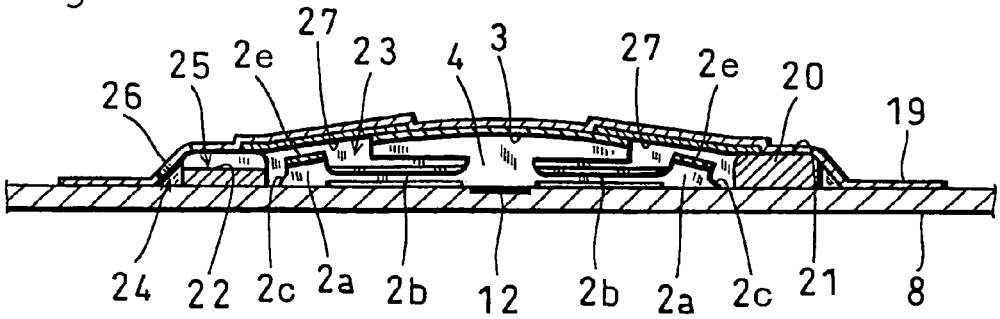
FIG. 8 is a central transverse sectional view showing an assembled state of the push-on switch of the second embodiment.
Figure 9:
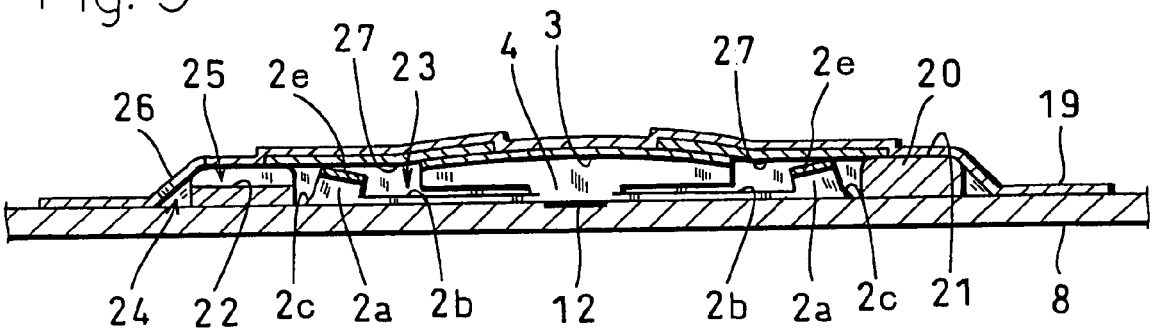
Figure 10A:
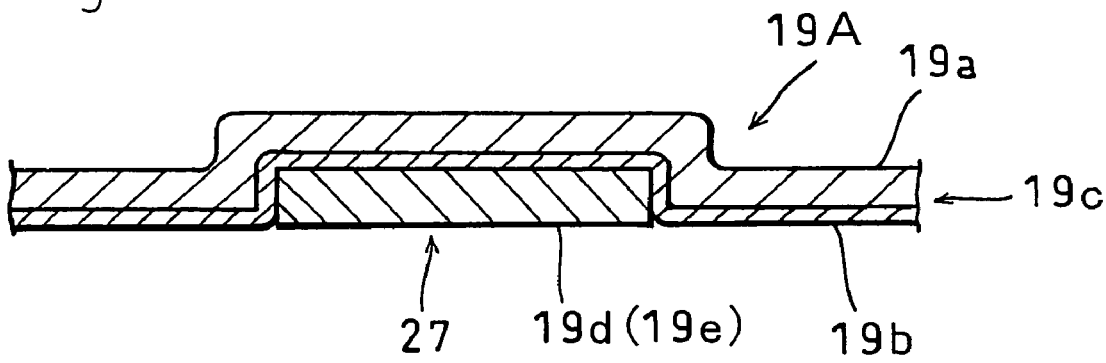
FIG. 10 is a sectional view showing the structure of an adhesive tape which is used in the push-on switch of the second embodiment.
Figure 10B:
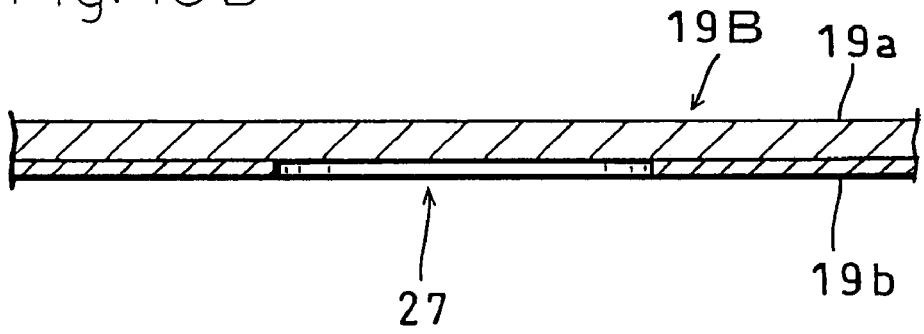
Figure 10C:
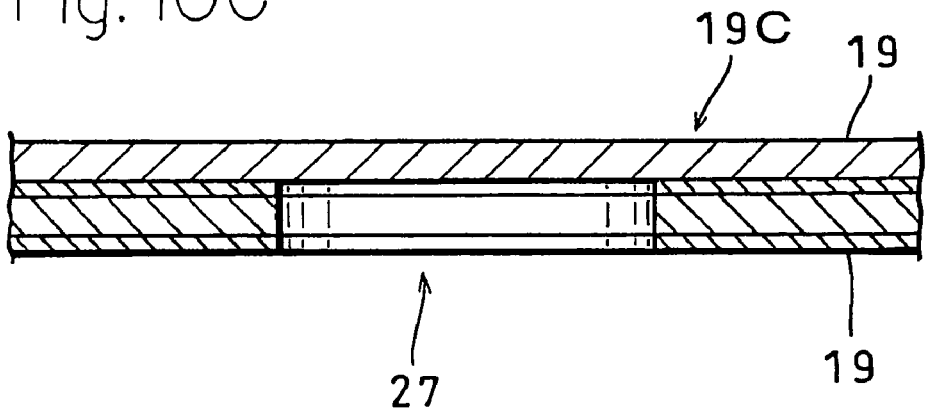

FIG. 7 is a plan view of a push-on switch of a second embodiment of the invention, FIG. 8 is a central transverse sectional view showing an assembled state of the push-on switch of the second embodiment, FIG. 9 is a central longitudinal sectional view of the push-on switch of the second embodiment showing a state where a first switch is turned ON, and FIG. 10 is a sectional view showing the structure of an adhesive tape which is used in the push-on switch of the second embodiment. The push-on switch of the second embodiment is identical in structure with that of the first embodiment except the structure of the adhesive tape. Therefore, the identical components are denoted by the same reference numerals, and their description is omitted.

The adhesive tape 19 used in the push-on switch of the second embodiment is different from the adhesive tape 9 used in the push-on switch of the first embodiment in that nonadhesive portions 27, 27 are formed in places opposing to parts of the peripheral plate portion 2 of the movable contact plate 1 excluding at least the connecting portions with the connecting plate portions 4, 4, respectively. Specifically, the nonadhesive portions 27, 27 are formed respectively in two positions of the peripheral plate portion 2 which are symmetrical about the long direction-center line X. Each of the nonadhesive portions 27, 27 is formed in a place opposing to an area of the peripheral plate portion 2 which extends from corresponding one of the long side portions 2*a*, 2*a* to positions of the short side portions 2*b*, 2*b* on the both sides of the long side portion, the positions being in short of the connecting portions with the connecting plate portions 4, 4 (short of the center in the longitudinal direction), i.e., a substantially half part of the peripheral plate portion 2 excluding center portions of the short side portions 2*b*, 2*b*. The nonadhesive portions 27, 27 have a rectangular shape of a slightly sufficient size in which a center part of one edge of the inner side overlaps a cutaway edge portion of the center plate portion 3 and the other three edges overlap the inner peripheral edge of the spacer 20, so that the portions can be easily formed into a simple shape and cope with slight misalignment during the process of bonding the adhesive tape 19, and the positioning of the tape can be easily conducted. In FIG. 7, the two inner rectangular portions respectively enclosed by double-dashed lines show the nonadhesive portions 27, 27.

As the adhesive tape 19 having the nonadhesive portions 27, 27, for example, adhesive tapes 19A, 19B, 19C respectively having tape structures shown in (A), (B), and (C) of FIG. 10 can be used. In the adhesive tape 19A shown in (A) of FIG. 10, the nonadhesive portions 27, 27 are formed by, to an adhesive tape 19*c* in which a layer 19*b* of an adhesive agent is formed over one whole surface of a tape base member 19*a* made of a resin film which has flexible, elastic, and insulative properties, bonding a tape base member 19*d* which is made of the same material, and in which an adhesive agent layer is not formed, or another adhesive tape 19*e* in which an adhesive agent layer is formed over one whole surface of the tape base member 19*d*, in positions where the nonadhesive portions 27, 27 are to be formed. In the adhesive tape 19B shown in (B) of FIG. 10, the nonadhesive portions 27, 27 are formed by, when an adhesive agent layer 19*b* is to be formed over one whole surface of a tape base member 19*a* made of a resin film which has flexible, elastic, and insulative properties, applying a masking process to the positions where the nonadhesive portions 27, 27 are to be formed. In the adhesive tape 19C shown in (C) of FIG. 10, the nonadhesive portions 27, 27 are formed by bonding a double-sided adhesive tape 19*b* (an adhesive tape in which an adhesive layer is formed on both the surfaces of a tape base member) which is cut away only in positions where the nonadhesive portions 27, 27 are to be formed.

The push-on switch is assembled while the movable contact plate 1 and the spacer 20 are directly positionally fixed onto the circuit board 8 in an integral manner with using the adhesive tape 19 having the nonadhesive portions 27, 27. As a result, the nonadhesive portions 27, 27 of the adhesive tape 19 are opposed to the peripheral plate portion 2. As shown in FIG. 9, even when the adhesive tape 19 approaches the peripheral plate portion 2 during the process of turning ON the first switch of the push-on switch and makes contact with the upper face of the peripheral plate portion 2 or particularly the upper faces of the bent portions 2*e*, 2*e*, therefore, it is possible to prevent the adhesive tape 19 from sticking to the peripheral plate portion 2 or the adhesive agent from adhering thereto. The push-on switch can sufficiently exhibit the original operation characteristics (elasticity) of the peripheral plate portion 2 such as expansion and contraction, and it is possible to obtain an original excellent sense of the first step.

As described above, each of the push-on switches of the first and second embodiments comprises the movable contact plate 1 having: the annular peripheral plate portion 2; the center plate portion 3 which is upward inflatingly curved; and the connecting plate portions 4, 4 which connect the peripheral plate portion and the center plate portion together. In the movable contact plate 1, the peripheral plate portion 2 is formed into an annular rectangular shape, the whole periphery of the peripheral plate portion 2 having an annular rectangular shape is upward inclined as advancing from the outer side edge toward the inner side edge, the grounding parts 2c, 2c, 2c, 2c are formed in the four corners of the peripheral plate portion 2, and the bent portions 2e, 2e which are upward protruded are formed in middle portions of the long side portions 2a, 2a. The connecting plate portions 4, 4 are formed as a pair to connect the inner side edge of the peripheral plate portion 2 to the outer peripheral edge of the center plate portion 3 on the center line X which is parallel to the long side portions 2a, 2a. The connecting plate portions 4, 4 are upward inclined as advancing from the peripheral plate portion 2 toward the center plate portion 3. The pair of the connecting plate portions 4, 4 are inverted by an operation of depressing the center plate portion 3 to a downward inclined state to make contact with the first stationary contacts 11, 11 on the circuit board 8, i.e., the first stationary contacts 11, 11 which are in the same plane as the supporting surface of the peripheral plate portion 2 having an annular rectangular shape. Subsequently, the center part of the center plate portion 3 is inverted to a downward inflated state with using the pair of the connecting plate portions 4, 4 as fulcrums to make contact with the second stationary contact 12 on the circuit board 8, i.e., the second stationary contact 12 which is in the same plane as the supporting surface of the peripheral plate portion 2 having an annular rectangular shape. The center plate portion 3 is formed into an oval shape which is obtained by cutting away peripheral portions of the circular plate 3a with two straight lines L1, L2 which are parallel to the long side portions 2a, 2a, and the distance between which is shorter than the relative distance between the inner side edges of the long side portions 2a, 2a. The circular plate 3a has a diameter R which is shorter than the relative distance between the inner side edges of the short side portions 2b, 2b of the peripheral plate portion 2 having an annular rectangular shape, and which is longer than the relative distance between the inner side edges of the long side portions 2a, 2a. Since the peripheral plate portion 2 is formed into an annular rectangular shape, the width of the movable contact plate 1 can be made small. In succession to the first-step operation in which the pair of connecting plate portions 4, 4 are inverted to the downward inclined state with providing a sense to make contact with the first stationary contacts 11, 11 of the circuit board 8, i.e., the first stationary contacts 11, 11 which are in the same plane as the support surface of the rectangular annular peripheral plate portion 2, conducted is the second-step operation in which the center part of the center plate portion 3 is inverted to the downward inflated state with providing a sense with using the pair of connecting plate portions 4, 4 as fulcrums to make contact with the second stationary contact 12 of the circuit board 8, i.e., the second stationary contact 12 which is in the same plane as the support surface of the rectangular annular peripheral plate portion 2. Even on the flat stationary-contact forming surface of the mounting board 8, therefore, each of the first- and second-step operations can be conducted with producing an excellent sense. Since the center plate portion 3 which functions in the second-step operation is formed into an oval shape, the size in the width direction can be decreased while realizing a long life period (high durability). As a result, it is possible to obtain an excellent sense and a long life period on the flat stationary-contact forming surface of the mounting board 8 such as a printed circuit board (PCB) or a flexible printed circuit board (FPC), while decreasing the width. The movable contact plate 1 is placed on the flat upper face of the circuit board 8 and fixed thereto by the adhesive tape 9 or 19 which is bonded from the side of the upper face. Therefore, the push-on switch has a simple two-step push-on switch structure which is economical and very thin, and which can realize an excellent sense and a long life period while decreasing the width, even on the flat stationary-contact forming surface of the circuit board 8. The push-on switch can be configured even on the circuit board 8 of a thin electronic apparatus or a small-width side face of such an apparatus.

The push-on switch comprises the annular spacer 20 placed around the movable contact plate 1 on the circuit board 8, and the continuous tape-sticking face 21 which is lower in level than the top of the center plate portion 3 and higher than the peripheral plate portion 2 is formed by the spacer 20 around the movable contact plate 1, whereby the tape-sticking face which is higher than the movable contact plate 1 is formed inside and outside the movable contact plate to prevent the adhesive tape 9 or 19 from sticking to the peripheral plate portion 2. According to the configuration, it is possible to prevent the operation characteristics (elasticity) of the peripheral plate portion 2 such as expansion and contraction from being deteriorated. Therefore, the first-step pressing load for turning ON the first switch can be prevented from being increased, and the first-step sense produced when the first switch is turned ON can be prevented from being blunted (deteriorated). As a result, it is possible to obtain a very thin two-step push-on switch in which the movable contact plate 1 configured by a metal plate spring can be fixed by the adhesive tape 9 or 19 onto the circuit board 8 without deteriorating the operation characteristics of the movable contact plate 1, and which has excellent operation characteristics.

The continuous tape-sticking face 21 is formed around the movable contact plate 1 with using the annular spacer 20. In comparison to a configuration in which a discontinuous tape-sticking face is formed around the movable contact plate 1 with using plural spacers, therefore, the production is more advantageous because the number of parts is small and the positioning of the spacer 20 with respect to the movable contact plate 1 can be easily conducted. Moreover, the push-on switch is advantageous to prevention of the adhesive tape 9 or 19 from sticking to the peripheral plate portion 2.

Furthermore, the air passage 25 through which the covered space 23 inside the annular spacer 20 covered by the adhesive tape 9 or 19 communicates with the covered space 24 outside the spacer is formed in the spacer 20, and the push-on switch further comprises the air escape means 26 through which the covered space 24 outside the annular spacer 20 communicates with the space outside the adhesive tape 9 or 19. Unlike a configuration where the air is caused to directly escape by opening a hole or a slit in the adhesive tape 9 or 19 in the portion of the movable contact plate 1, therefore, the air is caused to indirectly escape, and hence it is possible to prevent a contact failure due to penetration of dust into the portion of the movable contact plate 1 from occurring. According to the configuration, it is possible to obtain a very thin two-step push-on switch which has excellent operation characteristics while enhancing the dustproofness. From the viewpoint of the dustproofness also, the formation of the continuous tape-sticking face 20 around the movable contact plate 1 with using the annular spacer 20 is more advantageous than that of a discontinuous tape-sticking face around the movable contact plate 1 with using plural spacers.

In the adhesive tape 19 which fixes the movable contact plate 1 onto the circuit board 8, the nonadhesive portions 27, 27 are formed in places opposing to parts of the peripheral plate portion 2 of the movable contact plate 1 excluding at least the connecting portions with the connecting plate portions 4, 4, respectively. Even when the adhesive tape 19 makes contact with the peripheral plate portion 2 during the process of turning ON the first switch, therefore, it is possible to prevent the adhesive tape 19 from sticking to the peripheral plate portion 2. According to the configuration, it is possible to prevent the operation characteristics (elasticity) of the peripheral plate portion 2 such as expansion and contraction from being deteriorated. Therefore, the first-step pressing load for turning ON the first switch can be prevented from being increased, and the first-step sense produced when the first switch is turned ON can be prevented from being blunted (deteriorated). As a result, it is possible to obtain a very thin two-step push-on switch in which the movable contact plate 1 configured by a metal plate spring can be fixed by the adhesive tape 19 onto the circuit board 8 without deteriorating the operation characteristics of the movable contact plate 1, and which has excellent operation characteristics.

In the configuration where the adhesive tape 19 in which the nonadhesive portions 27, 27 are formed in places opposing to parts of the peripheral plate portion 2 of the movable contact plate 1 excluding at least the connecting portions with the connecting plate portions 4, 4, respectively is used as the adhesive tape for fixing the movable contact plate 1 onto the circuit board 8, it is possible to prevent the adhesive tape 19 from sticking to the peripheral plate portion 2 even when the above-described spacer 20 is not disposed. However, there is a case where the operation characteristics (elasticity) of the peripheral plate portion 2 such as expansion and contraction is deteriorated also by tape tension of the adhesive tape 19 which is in close contact with the peripheral plate portion 2. Therefore, the configuration where both the spacer 20 and the adhesive tape 19 in which the nonadhesive portions 27, 27 are formed are used is effectively used.

What is claimed is:

1. A push-on switch which comprises a movable contact plate formed by a metal plate spring, and in which said movable contact plate is fixed onto a circuit board by an adhesive tape that is bonded from a side of an upper face of said movable contact plate, said movable contact plate having: an annular peripheral plate portion; a center plate portion which is upward inflatingly curved; and connecting plate portions which connect said peripheral plate portion and said center plate portion together, said connecting plate portions being inverted by an operation of depressing said center plate portion to a downward inclined state to make contact with first stationary contacts on said circuit board, said center plate portion being then inverted to a downward inflated state to make contact with a second stationary contact on said circuit board, wherein said push-on switch further comprises a spacer which is placed around said movable contact plate on said circuit board, and a continuous or discontinuous tape-sticking face is formed by said spacer around said movable contact plate, said tape-sticking face being lower in level than a top of said center plate portion and higher than said peripheral plate portion.

2. A push-on switch according to claim 1, wherein a continuous tape-sticking face is formed around said movable contact plate with using an annular spacer.

3. A push-on switch according to claim 2, wherein an air passage through which a covered space inside said annular spacer covered by said adhesive tape is communicatingly connected to a covered space outside said spacer is formed in said spacer, and said push-on switch further comprises air escape means through which said covered space outside said spacer communicates with a space outside said adhesive tape.

4. A push-on switch according to claim 1, wherein a discontinuous tape-sticking face is formed around said movable contact plate with using a plurality of spacers.

5. A push-on switch according to claim 4, wherein said push-on switch further comprises air escape means through which a covered space outside said spacers and covered by the adhesive tape communicates outside said spacers with a space outside said adhesive tape.

6. A push-on switch which comprises a movable contact plate formed by a metal plate spring, and in which said movable contact plate is fixed onto a circuit board by an adhesive tape that is bonded from a side of an upper face of said movable contact plate, said movable contact plate having: an annular peripheral plate portion; a center plate portion which is upward inflatingly curved; and connecting plate portions which connect said peripheral plate portion and said center plate portion together, said connecting plate portions being inverted by an operation of depressing said center plate portion to a downward inclined state to make contact with first stationary contacts on said circuit board, said center plate portion being then inverted to a downward inflated state to make contact with a second stationary contact on said circuit board, wherein, in said adhesive tape which fixes said movable contact plate onto said circuit board, nonadhesive portions are formed in places opposing to parts of said peripheral plate portion of said movable contact plate excluding at least connecting portions with said connecting plate portions, respectively.

7. A push-on switch which comprises a movable contact plate formed by a metal plate spring, and in which said movable contact plate is fixed onto a circuit board by an adhesive tape that is bonded from a side of an upper face of said movable contact plate, said movable contact plate having: an annular peripheral plate portion; a center plate portion which is upward inflatingly curved; and connecting plate portions which connect said peripheral plate portion and said center plate portion together, said connecting plate portions being inverted by an operation of depressing said center plate portion to a downward inclined state to make contact with first stationary contacts on said circuit board, said center plate portion being then inverted to a downward inflated state to make contact with a second stationary contact on said circuit board, wherein said push-on switch further comprises a spacer which is placed around said movable contact plate on said circuit board, a continuous or discontinuous tape-sticking face is formed by said spacer around said movable contact plate, said tape-sticking face being lower in level than a top of said center plate portion and higher than said peripheral plate portion, and, in said adhesive tape which fixes said movable contact plate onto said circuit board, nonadhesive portions are formed in places opposing to parts of said peripheral plate portion of said movable contact plate excluding at least connecting portions with said connecting plate portions, respectively.

* * * * *